US008191300B2

(12) United States Patent
Daniel

(10) Patent No.: US 8,191,300 B2
(45) Date of Patent: Jun. 5, 2012

(54) HANDGUARD ASSEMBLY AND STANAG MOUNT ADAPTER ASSEMBLY

(75) Inventor: Marvin C. Daniel, Pooler, GA (US)

(73) Assignee: Daniel Defense, Inc., Black Creek, GA (US)

( * ) Notice: Subject to any disclaimer, the term of this patent is extended or adjusted under 35 U.S.C. 154(b) by 269 days.

(21) Appl. No.: 12/695,392

(22) Filed: Jan. 28, 2010

(65) Prior Publication Data

US 2010/0186278 A1 Jul. 29, 2010

Related U.S. Application Data

(60) Provisional application No. 61/147,964, filed on Jan. 28, 2009.

(51) Int. Cl.
*F41C 23/16* (2006.01)

(52) U.S. Cl. ..... 42/71.01; 42/75.01; 42/83; 42/90

(58) Field of Classification Search ..... 42/71.01, 42/75.01–75.03, 83, 90, 96, 143; 89/1.42
See application file for complete search history.

(56) References Cited

U.S. PATENT DOCUMENTS

| | | | | |
|---|---|---|---|---|
| 3,386,336 | A | 6/1968 | Roy | |
| 5,826,363 | A * | 10/1998 | Olson | 42/75.01 |
| 6,499,245 | B1 * | 12/2002 | Swan | 42/71.01 |
| 6,508,027 | B1 * | 1/2003 | Kim | 42/124 |
| 6,609,321 | B2 * | 8/2003 | Faifer | 42/71.01 |
| 7,523,580 | B1 * | 4/2009 | Tankersley | 42/71.01 |
| 7,716,865 | B2 * | 5/2010 | Daniel et al. | 42/75.02 |
| 7,770,317 | B1 * | 8/2010 | Tankersley | 42/71.01 |
| 8,046,949 | B1 * | 11/2011 | Daniel | 42/75.02 |
| 8,051,595 | B2 * | 11/2011 | Hochstrate et al. | 42/75.01 |
| 8,091,265 | B1 * | 1/2012 | Teetzel et al. | 42/72 |
| 2003/0074822 | A1 * | 4/2003 | Faifer | 42/71.01 |
| 2006/0010748 | A1 | 1/2006 | Stoner | |
| 2006/0201044 | A1 * | 9/2006 | Griffin | 42/105 |

(Continued)

FOREIGN PATENT DOCUMENTS

EP 1471325 A1 10/2004

(Continued)

OTHER PUBLICATIONS

Combined Search and Examination Report under Sections 17 and 18(3) for UK Application No. GB 1013996.2 dated Oct. 26, 2010.

(Continued)

*Primary Examiner* — Michael David
(74) *Attorney, Agent, or Firm* — Sutherland Asbill & Brennan LLP

(57) ABSTRACT

A handguard assembly for a firearm includes a stationary handguard portion, a movable handguard portion, a catch, and a latch mechanism. The catch is positioned on an interior of the handguard assembly, and the latch mechanism is position on an exterior of the handguard assembly. Both the catch and the latch mechanism maintain the movable handguard portion in a closed position. A STANAG mount adapter assembly includes a body portion, two flange portions, and an alignment mechanism. The flange portions are positioned on opposite lateral sides of the body portion and are configured to engage a STANAG mount, while the alignment adjustment mechanism is configured to adjust the lateral alignment of the body portion with reference to the STANAG mount. The STANAG mount adapter assembly can be used together with the handguard assembly to create an elongated rail platform on an SA80 rifle.

7 Claims, 6 Drawing Sheets

U.S. PATENT DOCUMENTS

| | | | | |
|---|---|---|---|---|
| 2008/0092422 | A1* | 4/2008 | Daniel et al. | 42/90 |
| 2010/0126054 | A1* | 5/2010 | Daniel et al. | 42/71.01 |
| 2010/0269682 | A1* | 10/2010 | Vuksanovich et al. | 89/191.01 |
| 2011/0016762 | A1* | 1/2011 | Davies | 42/75.01 |
| 2011/0016765 | A1* | 1/2011 | Griffin | 42/105 |
| 2012/0005936 | A1* | 1/2012 | Daniel | 42/71.01 |

FOREIGN PATENT DOCUMENTS

| | | | |
|---|---|---|---|
| GB | 2455760 | A | 12/2007 |
| GB | 2455760 | | 6/2009 |
| GB | 2455833 | | 6/2009 |
| GB | 2455833 | A | 6/2009 |

OTHER PUBLICATIONS

International Search Report and Written Opinion for PCT/US2010/022374, mailed Dec. 28, 2010.

International Preliminary Report on Patentability for International Application No. PCT/US2010/022374 issued Aug. 2, 2011.

Office Action for Application No. GB1013996.2 mailed Oct. 26, 2010.

* cited by examiner

HANDGUARD ASSEMBLY AND STANAG MOUNT ADAPTER ASSEMBLY

CROSS-REFERENCE TO RELATED APPLICATIONS

The present application claims priority to U.S. Provisional Application No. 61/147,964, filed on Jan. 28, 2009, which is incorporated by reference herein in its entirety.

TECHNICAL FIELD

The present application generally pertains to a handguard and a mounting adapter for a rifle, and more particularly relates to a handguard assembly and a STANAG mount adapter for a rifle.

BACKGROUND

The SA80 rifle is a type of rifle commonly employed by the British military. The term "SA80 rifle" generally denotes one of a family of rifles, which includes the L85A1 rifle and the L85A2 rifle, among others. Most SA80 rifles include a conventional handguard that can be opened from above to expose interior components of the rifle. Specifically, the conventional SA80 handguard includes an upper handguard portion and a lower handguard portion. The two handguard portions are coupled together via a hinge and a catch, which are located on opposite sides of the handguard. The catch generally maintains the upper handguard member in a closed position. When the catch is released, the upper handguard portion may be rotated about the hinge to expose interior components of the rifle, such as the gas piston system. This configuration may permit servicing the interior of the rifle without removing the handguard.

One problem with the conventional SA80 handguard is that the catch may not be secure enough to impede the handguard from opening inadvertently. Typically, the catch is a metal leaf spring having a fixed end and a free end. The fixed end is attached to the upper handguard portion, usually with a series of screws. The free end has a flange suited for engaging a groove on the lower handguard portion. When the upper handguard portion is closed, the bias of the catch may maintain the flange in the groove, securing the handguard portions together. To open the handguard, the upper handguard portion is engaged with enough force to overcome the bias in the catch, releasing the flange from the groove so that the upper handguard portion can be rotated away from the lower handguard portion. However, relatively little force may be required to remove the flange from the groove, reducing the security of the catch.

Another problem with the conventional SA80 handguard is that it does not feature a rail assembly. A rail assembly is a mounting platform for attaching accessories such as scopes and lasers to the rifle. Typically, the rail assembly includes a number of rails, each rail having mounting projections and grooves interleaved along its length that are used to attach the accessories to the rifle. The rails usually conform to accepted standards regarding shape and dimension set by military organizations such as the U.S. Department of Defense and NATO, examples of these standards including the Picatinny rail standard and the Weaver rail standard. Because the conventional SA80 handguard lacks such rails, however, it may be difficult to associate certain accessories with the rifle.

Instead of rails, the SA80 rifle may feature a STANAG mount, which is a type of mounting platform that conforms to a NATO Standardized Agreement. An example STANAG mount is shown in FIG. 8. The STANAG mount is positioned along the top of the upper receiver in general alignment with the barrel. To mount an accessory to the STANAG mount, the mount has two parallel mounting arms extending along its opposite lateral sides. The arms have projections that can mate with corresponding channels on the accessory. One problem with the STANAG mount is that its mounting arms differ in shape and configuration from the grooves and projections found on Picatinny and Weaver rails, and therefore the mount may not be suited for mounting some conventional accessories. Another problem with STANAG mount is that the mount is often misaligned along the rifle, tending to the left or the right. In such cases the mount imparts a corresponding misalignment on any accessory, which may decrease the effectiveness of the accessory. For example, the viewpoint of certain optics may be disturbed. The systems and methods of the present disclosure may alleviate one or more of these problems.

SUMMARY

Described below are embodiments of a handguard assembly for a firearm, which includes a stationary handguard portion, a movable handguard portion, a catch, and a latch mechanism. The movable handguard portion can be moved from a closed position to an opened position. The catch is positioned on an interior of the handguard assembly and maintains the movable handguard portion in the closed position. The latch mechanism is positioned on an exterior of the handguard assembly and further maintains the movable handguard portion in the closed position.

In embodiments, the catch is releasable upon the application of a force in a first direction; and the latch mechanism is releasable upon the application of a force in a second direction, the second direction being generally transverse to the first direction.

In particular embodiments, the latch mechanism includes a channel and a latch. The channel is formed on one of the handguard portions and the latch is attached to another of the handguard portions. A detent on the latch is configured to engage the channel when the latch is in the locked configuration and to disengage the channel when the latch is in the unlocked configuration. Thus, the latch is movable between locked and unlocked configurations.

The latch mechanism also may include other components, such as one or both of a pivot pin and a spring. The pivot pin permits rotating the latch between the locked and unlocked configurations. The spring is biased to normally maintain the latch to the locked configuration. In embodiments, the latch includes teeth on an opposite end from the detent and the spring is positioned behind the latch adjacent to the teeth. Also in some embodiments, the pivot pin is relatively closer to the spring than the detent.

At least one of the handguard portions may include a rail platform configured for associating an accessory with the rifle. The rail platform may conform at least in part to known standards, such as Picatinny or Weaver rail standards. In these and in other embodiments, the handguard portions may be sized and shaped for use with an SA80 rifle.

A STANAG mount adapter assembly is configured to attach to a STANAG mount, the STANAG mount having a base and two mounting arms extending along opposite lateral sides of the base. The STANAG adapter assembly includes a body portion, two flange portions, and an alignment adjustment mechanism. The flange portions are positioned on opposite lateral sides of the body portion, each flange portion configured to engage one of the mounting arms of the STANAG mount. The alignment adjustment mechanism is configured to adjust the lateral alignment of the body portion with reference to the base.

In embodiments, the STANAG mount further includes a projection on each of the mounting arms, in which case each flange portion further includes a receiving channel sized and shaped to engage the projection. In additional embodiments, the alignment adjustment mechanism may include a number of set screws extending through each flange portion. The set screws may permit lateral adjustment of the body portion with reference to the base. In still additional embodiments, the body portion may include a rail platform. The rail platform may conform at least in part to known standards, such as Picatinny or Weaver rail standards.

In some cases, an assembly for creating an elongated rail platform on an SA80 rifle includes a handguard and a STANAG mount adapter. The handguard has a first rail platform and the STANAG adapter has a second rail platform. The second rail platform is sized to abut the first rail platform when the handguard and the STANAG adapter are attached to the rifle. The handguard may be an embodiment of the SA80 handguard assembly disclosed herein, while the STANAG adapter may be an embodiment of the STANAG adapter assembly disclosed herein.

BRIEF DESCRIPTION OF THE FIGURES

The present disclosure may be better understood with reference to the following figures. Matching reference numerals designate corresponding parts throughout the figures, and components in the figures are not necessarily to scale.

DETAILED DESCRIPTION

Described below are embodiments of a handguard assembly that can be attached to a conventional SA80 rifle, such as an L85A1 rifle, an L85A2 rifle, or another rifle from the SA80 family of rifles, among others. The SA80 handguard assembly includes one or more features not present on a conventional SA80 handguard. For example, the SA80 handguard assembly may include a latch mechanism that assists with maintaining the handguard assembly in a closed position. The SA80 handguard assembly also may include one or more rail platforms suited for associating an accessory with the rifle.

Also described below are embodiments of a STANAG mount adapter assembly that can be joined to a STANAG mount to alter its functionality. For example, the STANAG adapter assembly may include one or more alternative rail platforms, such as a Picatinny or a Weaver rail platform. Thus, certain accessories that could not be attached to the SA80 rifle using a STANAG mount can be attached to the rifle. The alignment of the STANAG adapter assembly also may be adjustable, so that the STANAG adapter assembly can be aligned with the reference to the barrel even if the STANAG mount is misaligned. Thus, any accessory attached to the STANAG adapter assembly can be properly aligned even if the STANAG mount is misaligned.

Figure 1:
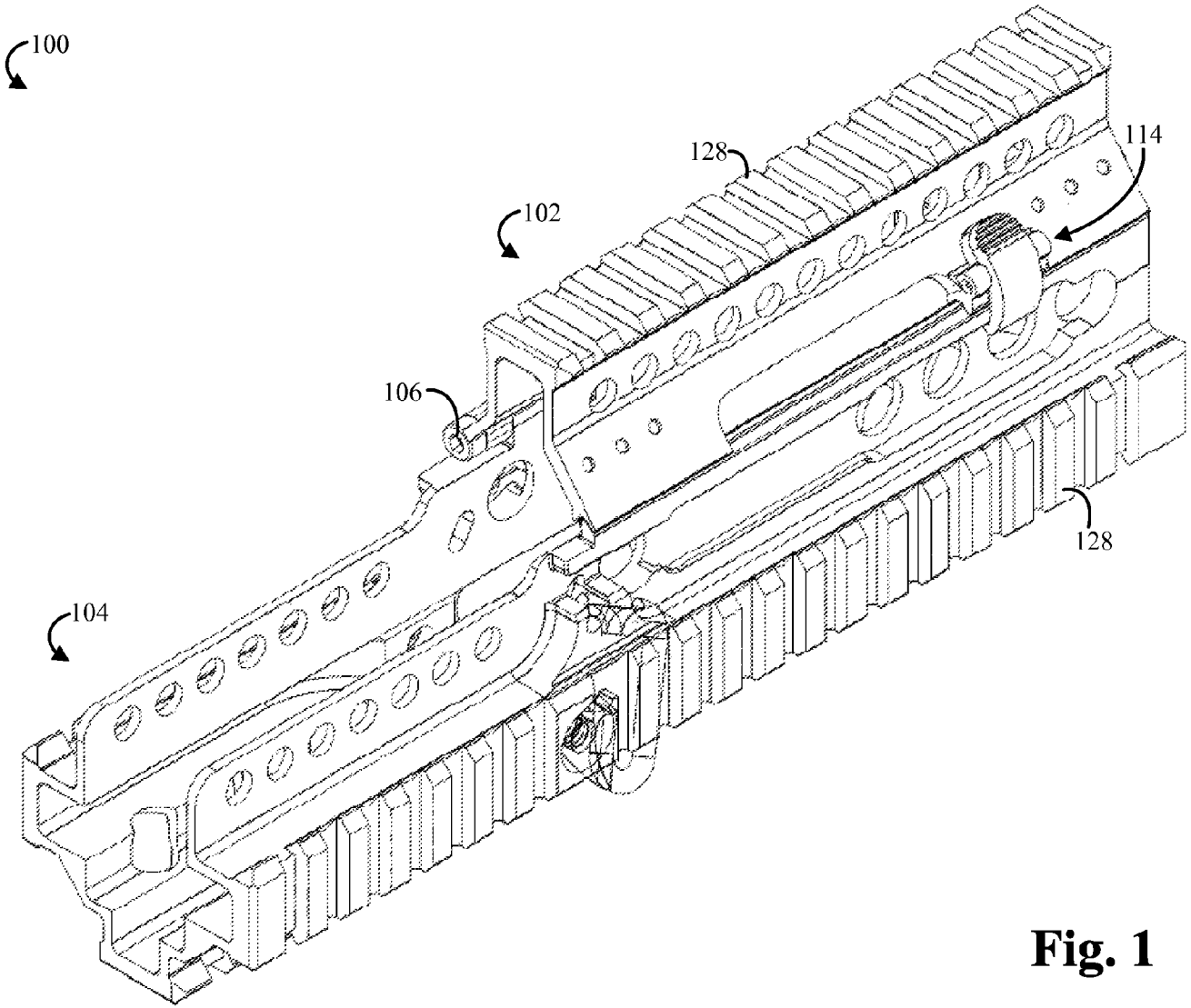
FIG. 1 is a perspective view of an embodiment of a handguard assembly.
Figure 2:
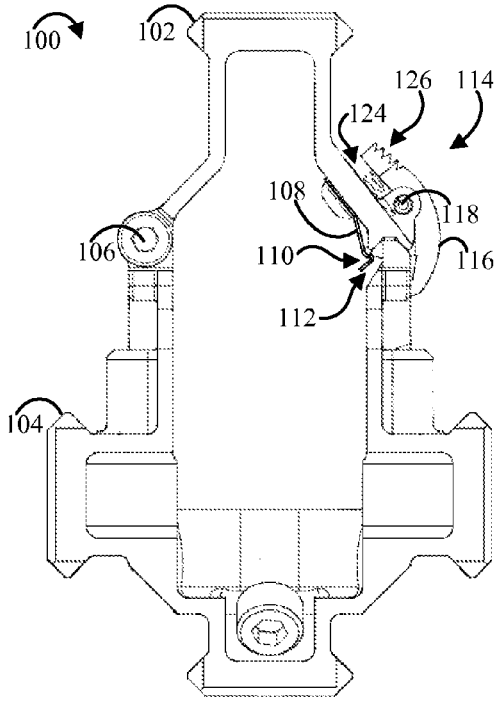
FIG. 2 is a front view of the embodiment of a handguard assembly shown in FIG. 1.
Figure 3:
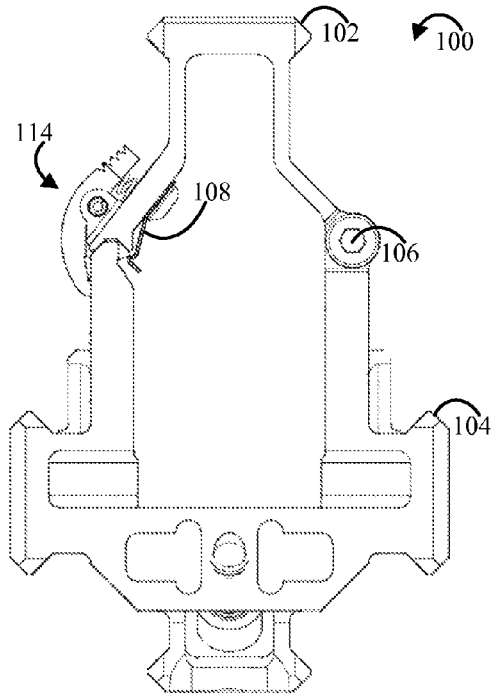
FIG. 3 is a rear view of the embodiment of a handguard assembly shown in FIG. 1.

FIG. 1 is a perspective view of an embodiment of the handguard assembly 100, while FIGS. 2 and 3 are front and rear views of the handguard assembly 100, respectively. The handguard assembly 100 may be suited for use with an SA80 rifle, among others. As shown, the SA80 handguard assembly 100 may include an upper or movable handguard portion 102 and a lower or stationary handguard portion 104. The two portions 102, 104 may be coupled together by a hinge 106. The hinge 106 may permit rotating the upper handguard portion 102 with reference to the lower handguard portion 104. Thus, the SA80 handguard assembly 100 may be opened to access components on an interior of the rifle.

It should be noted that the SA80 handguard assembly 100 is generally described and illustrated from the perspective of the operator when the SA80 handguard assembly is associated with the rifle in the intended orientation. The front view of FIG. 2 illustrates the SA80 handguard assembly 100 from the muzzle end of the rifle looking toward the operator, while the rear view of FIG. 3 illustrates the SA80 handguard assembly 100 from the breach end of the rifle looking toward the target. Also, directional terms such as upper and lower generally indicate the relative position of components from the perspective of the operator.

In the illustrated embodiment, the movable handguard portion is positioned on an upper side of the handguard assembly 100 while the stationary handguard portion is positioned on a lower side of the handguard assembly 100. In other embodiments, the configuration may be reversed. For example, the lower handguard portion 104 may be rotated about the hinge 106 to expose the interior components of the rifle, in which case the lower handguard portion 104 may be the movable handguard portion.

Figure 4:
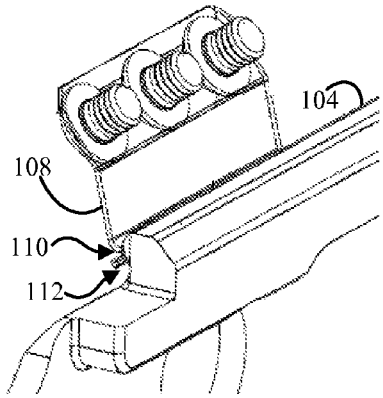
FIG. 4 is a perspective view of a portion of the embodiment of a handguard assembly shown in FIG. 1, illustrating the assembly with the upper handguard portion removed so that a catch is visible.

The SA80 handguard assembly 100 also may include a catch 108 that secures the upper handguard portion 102 in place when the upper handguard portion 102 is in the closed position against the lower handguard portion 104. The catch 108 may be located on an interior of the SA80 handguard assembly 100 as shown in FIGS. 2 and 3, and as shown in FIG. 4, which is a perspective view of a portion of the SA80 handguard assembly 100 illustrating the catch 108 in isolation adjacent to the lower handguard portion 104. As shown, the catch 108 may include a metal leaf spring having a fixed end and a free end. The fixed end may be attached to an inner wall of the upper handguard portion 102 with one or more fasteners, such as screws as shown. The free end may have a flange 110 suited for engaging a groove 112 on an inner wall of the lower handguard portion 104.

The catch 108 may have a bias that normally urges the catch 108 inward, toward the handguard assembly 100. Thus, when the upper handguard portion 102 is in a closed position, the bias of the catch 108 may maintain the flange 110 in the groove 112. To open the SA80 handguard assembly 100, the upper handguard member 102 may be rotated upward with sufficient force to overcome the bias of the catch 108, so that the flange 110 is released from the groove 112. Similarly, to close the SA80 handguard assembly 100, the upper handguard member 102 may be rotated downward with sufficient force to overcome the bias of the catch 108, so that the flange 110 can yield about the lower handguard portion 104. Once the upper handguard portion 102 reaches the closed position, the catch 108 returns to firmly seat the flange 110 in the groove 112, securing the handguard portions 102, 104 together. However, other configurations are possible. For example, the catch 108 may be reversed in orientation such that the fixed end is secured to the lower handguard portion 104 and the free end extends upward toward the upper handguard portion 102. The catch 108 also may be positioned on an exterior of the SA80 handguard assembly 100. However, the catch 108 is not necessary and may be omitted from the SA80 handguard assembly completely.

The SA80 handguard assembly 100 also may include a latch mechanism 114. The latch mechanism 114 facilitates maintaining the upper handguard portion 102 in the closed position. In particular, the latch mechanism 114 is normally in a locked configuration, can be moved to an unlocked configuration upon positive engagement by the user, and automatically returns to the locked configuration once disengaged.

Thus, the handguard assembly 100 can be opened by holding the latch mechanism 114 in the unlocked configuration while the upper handguard portion 104 is moved from the closed position, and the handguard assembly 100 can be closed by holding the latch 114 mechanism in the unlocked configuration while the upper handguard portion 102 is returned to the closed position. When the latch mechanism 114 is disengaged thereafter, the latch mechanism 114 returns to the locked configuration to secure the upper handguard portion 102 in the closed position.

In embodiments featuring a latch mechanism 114, the catch 108 may be omitted. Alternatively, the latch mechanism 114 and catch 108 may both be included to provide redundancy, further reducing the likelihood that the SA80 handguard assembly 100 will open inadvertently. In such embodiments, the latch mechanism 114 may be released with a different hand motion than the catch 108 to further reduce the likelihood of inadvertent opening. For example, the catch 108 may be released with an upward motion while the latch mechanism 114 may be released with an inward motion.

Figure 5:
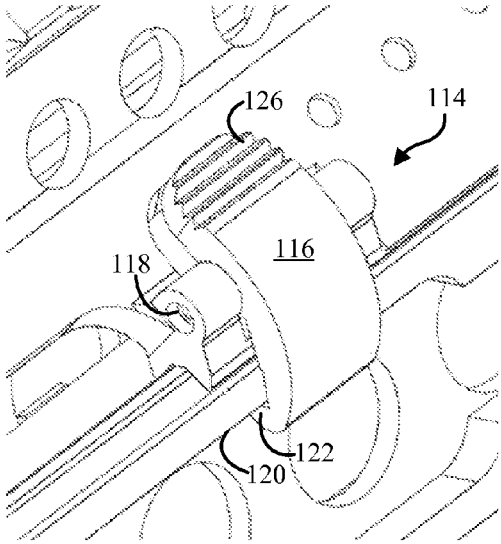
FIG. 5 is a perspective view of a portion of the embodiment of a handguard assembly shown in FIG. 1, illustrating a latch mechanism of the assembly.
Figure 6:
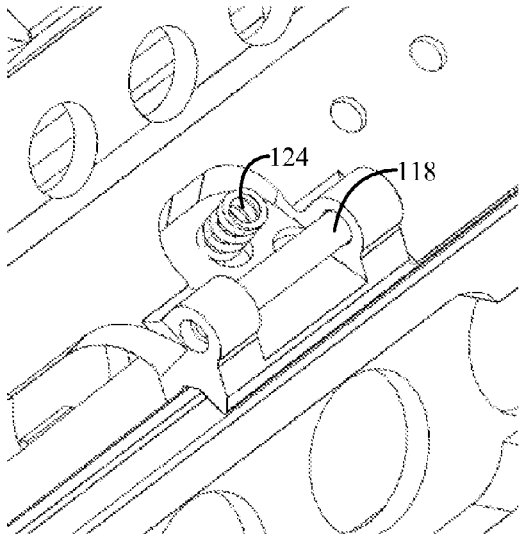
FIG. 6 is a perspective view of a portion of the embodiment of a handguard assembly shown in FIG. 1, illustrating a latch mechanism of the assembly with the latch removed.
Figure 7:
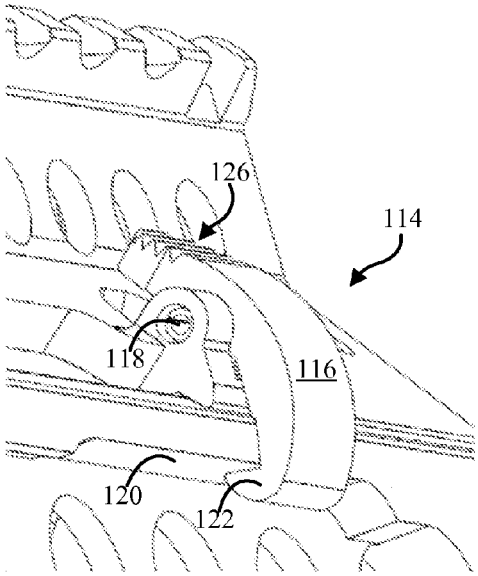
FIG. 7 is a perspective view of a portion of the embodiment of a handguard assembly shown in FIG. 1, illustrating the latch mechanism of the assembly from below.

An embodiment of a latch mechanism 114 is shown in detail in FIGS. 5-7. The latch mechanism 114 may include a latch 116 associated with the SA80 handguard assembly 100 via a pivot pin 118. The pivot pin 118 is visible in FIG. 6, which illustrates the latch mechanism 114 with the latch 116 removed. The pivot pin 118 may permit rotating the latch 116 between locked and unlocked configurations. In particular, the latch 116 is mounted about the pivot pin 118 on the upper handguard portion 102 extending toward the lower handguard portion 104.

The latch 116 includes a detent 122 on its lower end that is sized and shaped to engage a channel 120 formed in the lower handguard portion 104. The channel 120 is best seen in FIG. 7, which illustrates the latch mechanism 114 from below. The size of the latch 116 and the positioning of the pivot pin 118 are selected so that when the upper handguard portion 102 is in the closed position, the detent 122 is positioned in the channel 120. Rotating the latch 116 about the pivot pin 118 selectively engages or disengages the detent 122 within the channel 120 to selectively lock and unlock the latch mechanism 114, securing or releasing the handguard portions 102, 104.

To facilitate maintaining the latch 116 in a normally closed position, the latch mechanism 114 further includes a spring 124. An embodiment of the spring 124 is visible in FIGS. 2-3, and in FIG. 6, which illustrates the latch mechanism 114 with the latch 116 removed. As shown, the spring 124 may be positioned on the upper handguard portion 102 behind an upper portion of the latch 116. The spring 124 normally biases the upper portion of the latch 116 outward, such that the lower portion of the latch 116 is biased inward, maintaining the detent 122 in the channel 120 when the upper handguard portion 102 is in the closed position.

To facilitate moving the latch 116 to an opened position, the latch 116 may be depressed against the bias of the spring 124. The upper portion of the latch 116 may pivot inward, rotating the lower portion of the latch 116 outward so that the detent 122 is removed from the channel 120. The upper handguard portion 102 can then be rotated upward. Once the force is removed from the upper portion of the latch 116, the spring 124 may return. The upper portion of the latch 116 may pivot outward, rotating the lower portion of the latch 116 inward. If the upper handguard portion 102 is in the closed position, the detent 122 may once again engage the channel 120 to secure the handguard portions 102, 104 together.

In embodiments, the pivot pin 118 may be off-center with reference to the latch 116. In other words, the latch 116 may be mounted on the pivot pin 118 such that a relatively smaller portion of the latch 116 is positioned above the pivot pin 118 than below the pivot pin 118. Such positioning of the latch 116 on the pivot pin 118 may amplify the bias of the spring 124 to further secure the detent 122 in the channel 120.

In embodiments, an outer surface of the upper portion of the latch 116 may have a series of teeth 126. The teeth 126 may impede the user's finger from slipping from the latch 116. The teeth 126 also may serve as an indicator of the location of the spring 124, guiding the user to the appropriate point for releasing the latch 116.

It should be noted that the latch 116, pivot pin 118, and spring 124 are shown mounted on the upper handguard portion 102 by way of example. The reverse configuration is also possible, in which case the detent 122 may be formed on the upper portion of the latch 116, the teeth 126 may be formed on the lower portion of the latch 116, and the channel 120 may run along a portion of the upper handguard portion 102.

In embodiments, the pivot pin 118 may align with a longitudinal axis of the rifle, so that the latch 116 rotates in a plane generally perpendicular to the longitudinal axis of the rifle. Thus, the hand motion required to open the latch 116 may be different from the hand motion used to release the catch 108. For example, the catch 108 may be released by applying an upward force to the upper handguard portion 102, while the latch 116 may be released by applying an inward force to the latch 116. Thus, with reference to the barrel, the forces required to release the catch 108 and the latch 116 are generally transverse to each other, with an upward perpendicular force releasing the catch 108 and an inward perpendicular force releasing the latch 116. In such embodiments, the SA80 handguard assembly 100 may be relatively unlikely to opening inadvertently, as opening the handguard assembly may require two disparate hand motions. In other embodiments, the catch 108 and the latch 116 may be positioned otherwise, yet may still open upon the application of forces applied in two different directions, such as directions that are generally transverse to each other.

In embodiments, the SA80 handguard assembly 100 may include one or more rail platforms 128. In the illustrated embodiment, for example, the SA80 handguard assembly 100 includes four rail platforms 128 located on upper, lower, left and right sides of the handguard assembly 100. The rail platforms 128 facilitate associating one or more accessories with the rifle. Example accessories include vertical grips, optics, laser sights, flashlights, sling attachment points, night vision sighting equipment, infrared lasers, visible light illuminators, and infrared illuminators, among others. In embodiments, the rail platforms 128 may conform to accepted standards, such as Picatinny or Weaver rails standards, which have shapes and dimensions that are known in the art. In such embodiments, accessories can be attached to the SA80 handguard assembly 100 that could not be attached to the rifle, such as accessories that are designed specifically for use with Picatinny or Weaver rails. In other embodiments, any other style rail platform 128 may be used, although the rail platforms 128 are not necessary and may be omitted.

In embodiments, the size and shape of the SA80 handguard assembly 100 may generally correspond to a conventional SA80 handguard. In such embodiments, an operator of an SA80 may replace the existing handguard with an embodiment of the SA80 handguard assembly 100 to provide the latch mechanism 114, to provide the rail platform 128, or a combination thereof. In other embodiments, the SA80 handguard assembly 100 may further feature an elevated upper surface. More particularly, the rail platform 128 positioned on an upper side of the upper handguard portion 102 may be elevated with reference to the upper surface of a conventional SA80 handguard. The elevated height of the upper surface may facilitate using certain optics. Further, the elevated height of the upper surface may facilitate aligning the SA80 rail assembly 100 with an embodiment of a STANAG mount adapter assembly described below.

In embodiments, the SA80 handguard assembly 100 may be removably attached to the rifle in a conventional manner. For example, the SA80 handguard assembly 100 may employ conventional mounting means, such as screws and tabs located on opposite ends of the lower handguard portion 104, which are comparable to the mounting means found on a conventional SA80 handguard. Embodiments of such mounting means are visible in FIGS. 2 and 3. Thus, the SA80 handguard assembly 100 of the present disclosure may be attached to a rifle in a conventional manner, using familiar hand motions. Such a configuration may facilitate retrofitting an existing rifle with the SA80 handguard assembly 100. A person of skill would have a clear understanding of the mounting means and how the mounting means operate based on this disclosure, as such information is known in the art.

Figure 8:
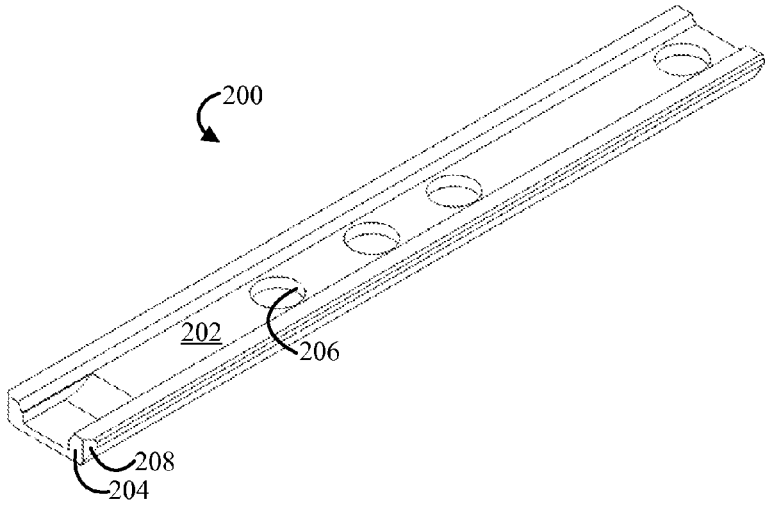
FIG. 8 is a perspective view of an embodiment of a prior art STANAG mount.

As mentioned above, the SA80 and other known rifles often include a STANAG mount, which is a mounting platform that facilitates attaching accessories to the rifle. FIG. 8 is a perspective view of an embodiment of a prior art STANAG mount 200. As shown, the STANAG mount 200 generally includes a base 202, two mounting arms 204 that extend along opposite lateral sides of the base 202, and a number of bores 206 formed through a lower side of the base 202. Each mounting arm 204 may have a projection 208 that extends along its length for engaging correspondingly shaped channels or other receiving structures on an accessory. For example, the projections 208 may have triangular- or dovetail-shaped cross-sections, although other configurations are possible. Further, the bores 206 may be cylindrical. The STANAG mount 200 is typically attached to the rifle along an upper surface of the upper receiver such that the base 202 and mounting arms 204 extend along the rifle in generally alignment with the barrel. In use, the STANAG mount 200 can be used to attach an accessory to the rifle, particular via the mounting arms 204 and bores 206.

The present disclosure also pertains to a STANAG mount adapter assembly. The STANAG adapter assembly can be joined to a STANAG mount to alter its functionality in one or more ways. For example, the STANAG adapter assembly may include a rail platform, such as a Picatinny or a Weaver rail platform. Thus, attaching the STANAG adapter assembly to the rifle facilitates attaching certain accessories to the rifle via the rail platform, including accessories that could not be attached to the rifle using the STANAG mount alone. The STANAG adapter assembly also may include an alignment adjustment mechanism. The alignment adjustment mechanism may facilitate adjusting the alignment of the STANAG adapter with reference to the STANAG mount, so that the STANAG adapter assembly can be aligned with the reference to the barrel even if the STANAG mount is misaligned with reference to the barrel. Thus, any accessory attached to the STANAG adapter assembly can be properly aligned even if the STANAG mount is misaligned.

Figure 9:
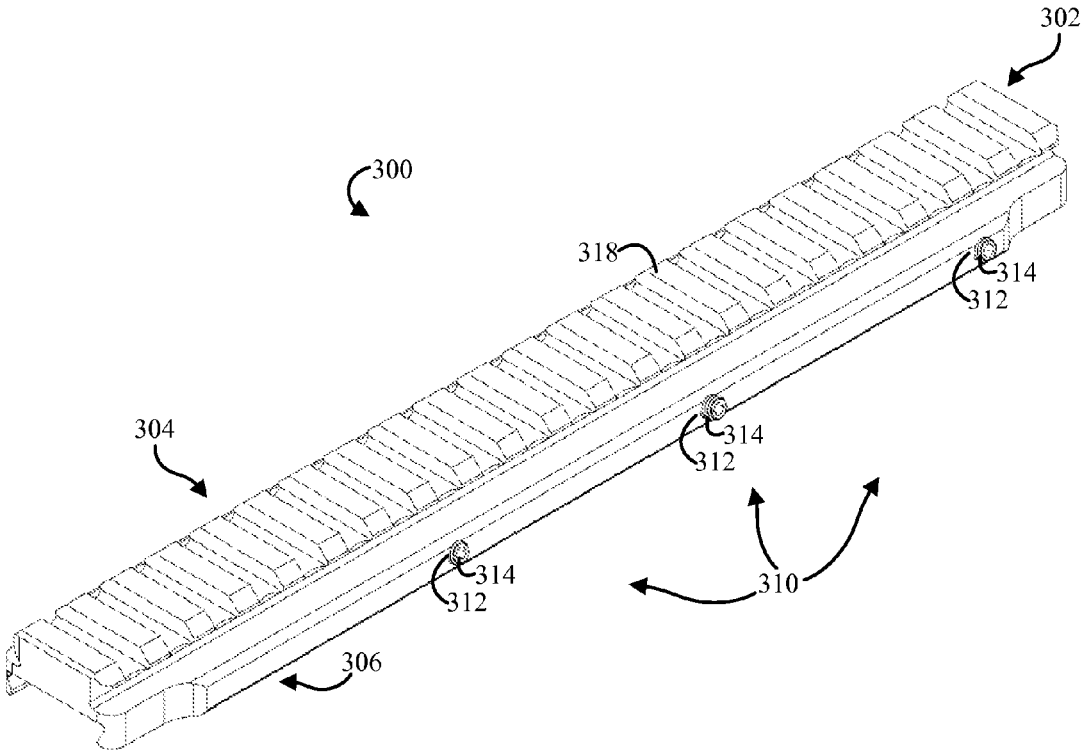
FIG. 9 is a perspective view of an embodiment of a STANAG mount adapter assembly configured for attaching to a prior art STANAG mount of the type shown in FIG. 8.
Figure 10:
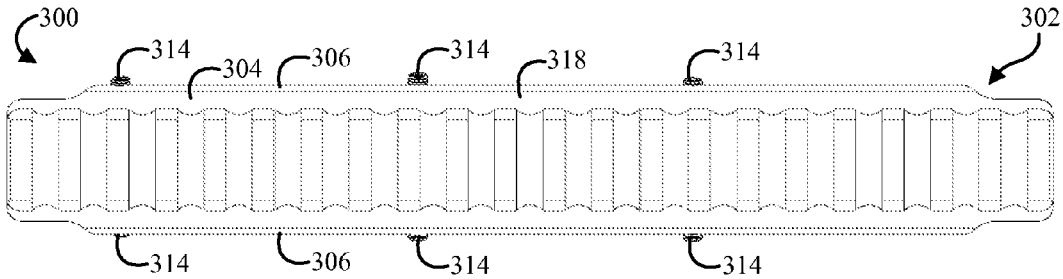
FIG. 10 is a top view of the embodiment of a STANAG adapter assembly shown in FIG. 9.
Figure 11:
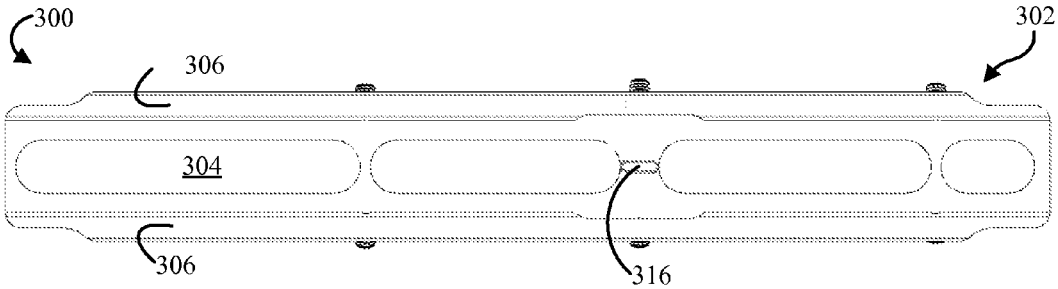
FIG. 11 is a bottom view of the embodiment of a STANAG adapter assembly shown in FIG. 9.
Figure 12:
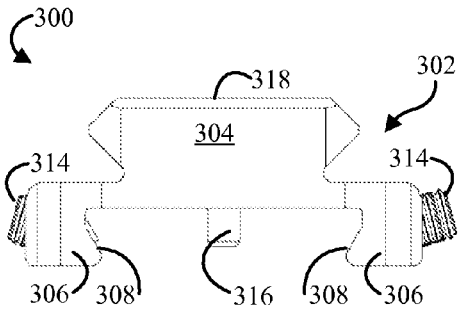
FIG. 12 is a front view of the embodiment of a STANAG adapter assembly shown in FIG. 9.
Figure 13:
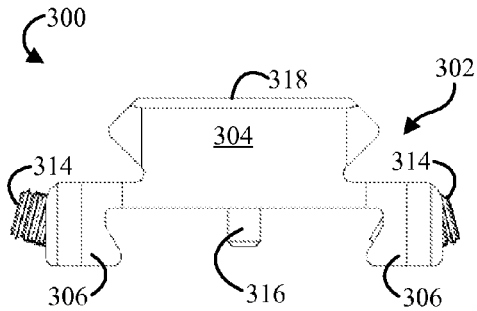
FIG. 13 is a rear view of the embodiment of a STANAG adapter assembly shown in FIG. 9.

FIG. 9 is a perspective view of an embodiment of a STANAG adapter assembly 300 that can be attached to a conventional STANAG mount, such as the STANAG mount 200 shown in FIG. 8. The STANAG adapter assembly 300 is further illustrated in FIGS. 10-13, which are top, bottom, front, and rear views, respectively. As shown, the STANAG adapter assembly 300 includes a body 302 that is generally shaped to mate with the STANAG mount 200. In particular, the body 302 includes an upper platform 304 and two flanges 306 extending along opposite lateral sides of the upper platform 304. Receiving channels 308 formed on an inner side of the flanges 306 may be configured to loosely receive the projections 208 on the mounting arms 204 of the STANAG mount 200. For example, the receiving channels 308 may have a triangular cross-section that generally corresponds to the triangular cross-section of the projections 208 on the mounting arms 204, as shown in FIGS. 12-13. It should be noted that the body 302 may have any shape that corresponds at least in part to the shape of the STANAG mount 200.

The STANAG adapter assembly 300 may be associated with the STANAG mount 200 in a variety of manners. In the illustrated embodiment, the body 302 is a single piece that is slid onto the STANAG mount 200 from one end. In other embodiments, the body 302 may be more than one piece. For example, the body 302 may include a main body portion and a clamp portion. The two portions may be positioned about opposite lateral sides of the STANAG mount 200 to associate the STANAG adapter assembly 300 with the rifle, such as using a clamping force. In such embodiments, fasteners such as screws may be used to attach the main body portion to the clamp portion once the STANAG adapter assembly 300 is positioned about the STANAG mount 200.

As mentioned above, the STANAG adapter assembly 300 may include an alignment adjustment mechanism 310. The alignment adjustment mechanism 310 facilitates aligning the STANAG adapter assembly 300 with reference to the longitudinal axis of the rifle. As shown, the alignment adjustment mechanism 310 includes a number of openings 312 formed through the flanges 306 and a number of set screws 314 positioned in the openings 312. When the set screws 314 are adjusted, the set screws 314 may contact the projections 208 on the mounting arms 204. The set screws 314 may be tightened to secure the body 302 about the mounting arms 204.

The set screws 314 also may be adjusted to determine the lateral orientation of the STANAG adapter assembly 300 with reference to the STANAG mount 200, and therefore the rifle. Thus, the STANAG adapter assembly 300 may be properly aligned with reference to the longitudinal axis of the rifle by adjusting one or more of the set screws 314, even in embodiments in which the STANAG mount 200 is misaligned along the rifle. Six set screws 314 are shown in the illustrated embodiment, with three on each lateral side, although any number may be used. The set screws 314 may be longitudinally spaced along the STANAG adapter assembly 300 as shown, although any configuration is possible.

It should be noted that the fit of the body 302 about the STANAG mount 200 may generally maintain the STANAG adapter assembly 300 in a particular lateral orientation, while the set screws 314 refine the lateral orientation and secure the STANAG adapter assembly 300 to the rifle. In other words, the body 302 is sized to provide sufficient "wiggle room" between the flanges 306 and the mounting arms 204 so that the lateral orientation can be adjusted with the set screws 314.

The STANAG adapter assembly 300 also may have one or more aligning protuberances 316. The aligning protuberance 316 may extend downward from an inner surface of the body 302, as shown in FIGS. 11-13. The location of the aligning protuberance 316 may correspond to the location of a bore 206 in the STANAG mount 200, but the aligning protuberance 316 may be smaller in size than the corresponding bore 206. Thus, when the body 302 is slid onto the STANAG mount 200, the aligning protuberance 316 may register with the corresponding bores 206 to indicate the STANAG adapter assembly 300 is in a generally acceptable position. The aligning protuberance 316 also may facilitate retaining the body 302 on the STANAG mount 200 until the set screws 314 can be tightened to secure the STANAG adapter assembly 300 in place.

In embodiments, the STANAG adapter assembly 300 may include a rail platform 318. In such embodiments, the STANAG adapter assembly 300 may facilitate converting the STANAG mount 200 to other known mounting standards. For example, the rail platform 318 may include a Picatinny-type rail or a Weaver-type rail, which have shapes and dimensions that are known in the art as described above. The rail platform 318 may facilitate associating one or more accessories with the rifle, including accessories that could not be attached to the rifle using a STANAG mount alone.

Figure 14:
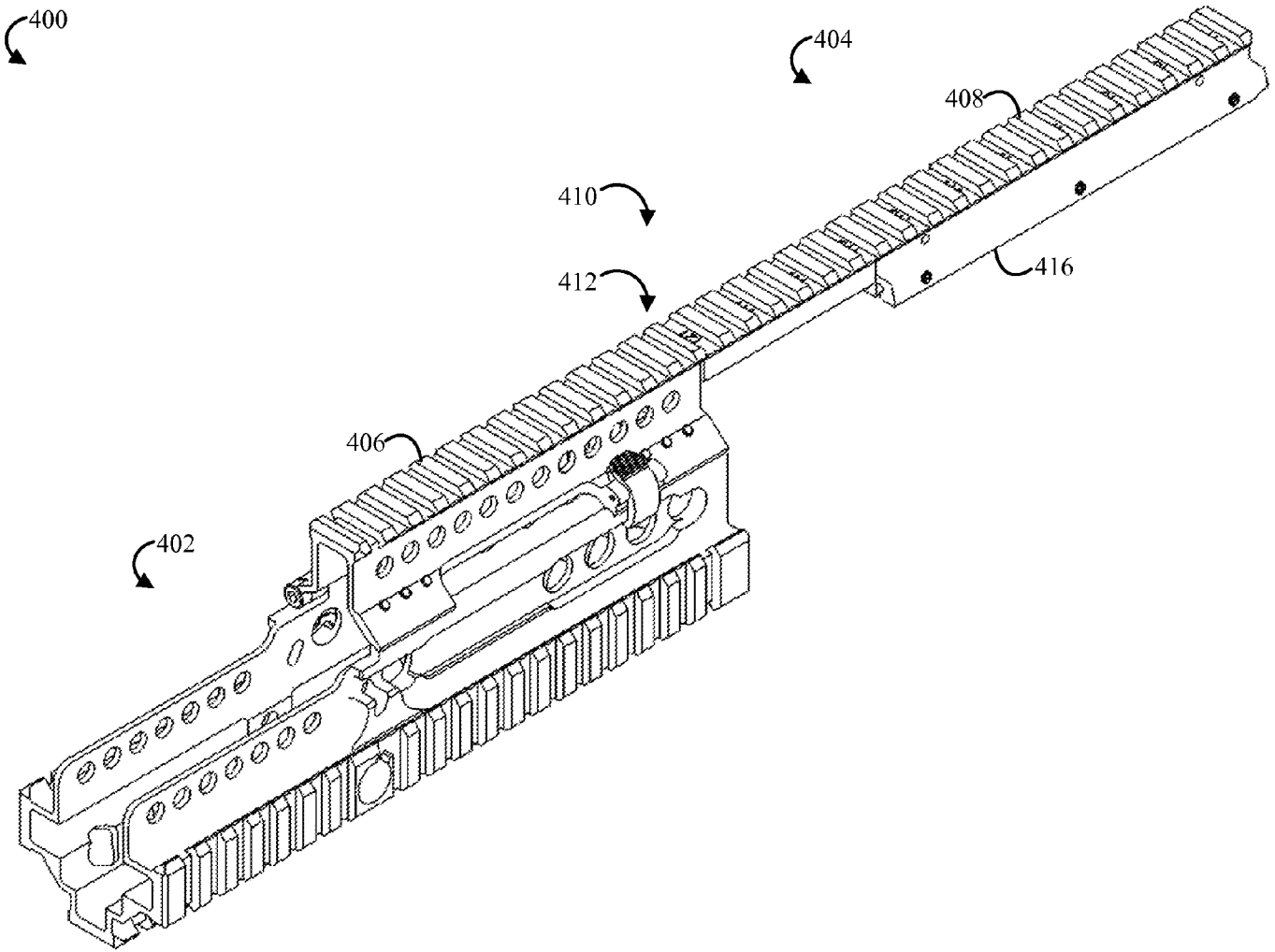
FIG. 14 is a perspective view of an embodiment of a SA80 handguard assembly and STANAG mount adapter assembly.

In embodiments, the STANAG adapter assembly may be configured to form a relatively continuous rail platform with the SA80 handguard assembly when both assemblies are attached to the rifle. An example of such a configuration is shown in FIG. 14, which is a perspective view of an embodiment of a SA80 handguard and STANAG mount adapter assembly 400. The SA80 handguard and STANAG adapter assembly 400 generally includes an SA80 handguard assembly 402 and a STANAG adapter assembly 404 positioned adjacent to each other. The SA80 handguard assembly 402 may be an embodiment of the SA80 handguard assembly described above. Similarly, the STANAG mount adapter assembly 404 may be an embodiment of the STANAG mount adapter assembly described above.

As shown, the rail platforms 406, 408 of the SA80 handguard assembly 402 and the rail platform STANAG adapter assembly 404 are sized to abut each other at a point 412 when both assemblies 402, 404 are attached to the rifle. Thus, a relatively continuous rail platform 410 may extend along an upper side of the rifle, formed from two constituent rail platforms 406, 408 that may not actually attach to each other.

In such embodiments, the height of the SA80 handguard assembly 402 and the height of the STANAG adapter assembly 404 may be sized so that the upper surfaces of the rail platforms 406, 408 align with each other once both assemblies 402, 404 are associated with the rifle. Further, the lengths of the two rail platforms 406, 408 may be sized so that the rail platforms abut each other once both assemblies 402, 404 are associated with the rifle. Such sizing may facilitate creating the relatively continuous rail platform 410 along the top of the rifle, even though the two component rail platforms 406, 408 may not attach to each other.

To achieve such sizing, the STANAG adapter assembly 404 may have a longitudinal length that exceeds a longitudinal length of the STANAG mount 200. In such embodiments, the STANAG adapter assembly 404 may have flanges 416 that extend along only a portion of the rail platform 408. The remaining portion of the rail platform 408 may be cantilevered over the rifle when the STANAG adapter assembly 404 is attached to the STANAG mount 402. To support the cantilevered portion, a support tab may be positioned on underside of the cantilevered portion. The support tab may extend downward from the cantilevered portion. When a downward force is applied to the cantilevered portion, the support tab may contact the rifle to support the cantilevered portion against the rifle. The support tab may also facilitate transferring the weight of an accessory attached to the cantilevered portion of the rail platform 408 to the rifle.

However, other configurations are possible. For example, the STANAG adapter assembly 300 shown in FIGS. 9-13 has a longitudinal length that exceeds that of the STANAG mount 200 and yet the flanges 306 extend along the entire longitudinal length of the rail platform 318. When the STANAG adapter assembly 300 is associated with the STANAG mount 200, a portion of the rail platform 318 may be positioned adjacent to the STANAG mount 200 and a portion of the rail platform 318 may be cantilevered over the rifle. Thus, a portion of the flanges 306 may engage the mounting arms 204 to attach the STANAG adapter assembly 300 to the rifle, while the remaining portion of the flanges 306 may support the cantilevered portion of the rail platform 318 against the rifle. When a downward force is applied to the cantilevered portion, the flanges 306 may transfer the force to the rifle. The flanges 306 also may facilitate transferring the weight of an accessory attached to the cantilevered portion of the rail platform 318 to the rifle. In such embodiments, the channels 308 may or may not extend along the entire length of the flanges 306.

Embodiments of an SA80 rail assembly and embodiments of a STANAG adapter assembly have been described above separately. However, the SA80 rail assembly and the STANAG adapter assembly may be used in any combination. For example, any embodiment of the SA80 rail assembly can be used alone or in combination with any embodiment of a STANAG adapter assembly. Similarly, any embodiment of the STANAG adapter assembly can be used alone or in combination with any embodiment of the SA80 rail assembly. These assemblies can be used in association with an SA80 rifle, or other rifles as appropriate.

Other systems, devices, methods, features, and aspects of the disclosed systems and methods will be apparent or will become apparent to one with skill in the art upon examination of the following figures and detailed description. All such additional systems, devices, methods, features, and aspects are intended to be included within the description. While particular embodiments have been disclosed in detail in the foregoing description and figures for purposes of example, those skilled in the art will understand that variations and modifications may be made without departing from the scope of the disclosure. All such variations and modifications are intended to be included within the scope of the present disclosure.

At least the following is claimed:

1. A handguard assembly for a firearm, comprising:

a stationary handguard portion;

a movable handguard portion that can be moved from a closed position to an opened position;

a catch positioned on an interior of the handguard assembly, the catch maintaining the movable handguard portion in the closed position; and a latch mechanism positioned on an exterior of the handguard assembly, the latch mechanism further maintaining the movable handguard portion in the closed position, the latch mechanism comprising:

a channel formed on one of the handguard portions;

a latch attached to another of the handguard portions, the latch movable between locked and unlocked configurations, the latch comprising a detent configured to engage the channel when the latch is in the locked configuration and to disengage the channel when the latch is in the unlocked configuration;

a pivot pin that permits rotating the latch between the locked and unlocked configurations;

a spring that is biased to normally maintain the latch to the locked configuration;

the latch comprises a plurality of teeth on an opposite end from the detent; and the spring is positioned behind the latch adjacent to the teeth.

2. The handguard assembly of claim 1, wherein the pivot pin is relatively closer to the spring than the detent.

3. The handguard assembly of claim 1, wherein at least one of the handguard portions comprises a rail platform configured for associating an accessory with the rifle.

4. The handguard assembly of claim 3, wherein the rail platform comprises one of the following: a Picatinny rail and a Weaver rail.

5. The handguard assembly of claim 4, wherein the handguard portions are sized and shaped for use with an SA80 rifle.

6. The handguard assembly of claim 1, wherein the handguard portions are sized and shaped for use with an SA80 rifle.

7. The handguard assembly of claim 1, wherein:

the catch is releasable upon the application of a force in a first direction; and the latch mechanism is releasable upon the application of a force in a second direction, the second direction being generally transverse to the first direction.

* * * * *